US006138762A

United States Patent [19]

Sweeney et al.

[11] Patent Number: 6,138,762

[45] **Date of Patent: *Oct. 31, 2000**

[54] WELLHEAD CONNECTOR WITH ADDITIONAL LOAD SHOULDERS

[75] Inventors: Thomas F. Sweeney, Tomball, Tex.; Thomas A. Fraser, Ventura, Calif.; Glen H. Cuiper, Spring; Brian L. Kirk, Bellaire, both of Tex.

[73] Assignee: ABB Vetco Gray Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/022,571

[22] Filed: Feb. 12, 1998

[51] Int. Cl.[7] ..... E21B 7/12

[52] U.S. Cl. ..... 166/359; 166/338; 166/350; 285/18

[58] Field of Search ..... 166/338–349, 166/365, 350, 359, 367; 285/18

[56] References Cited

U.S. PATENT DOCUMENTS

| | | | |
|---|---|---|---|
| 3,321,217 | 5/1967 | Ahlstone | 166/338 X |
| 3,427,048 | 2/1969 | Brown | 166/338 X |
| 4,057,267 | 11/1977 | Jansen, Jr. . | |
| 4,708,376 | 11/1987 | Jennings et al. | 285/18 X |
| 5,141,257 | 8/1992 | Taylor | 285/18 |
| 5,247,996 | 9/1993 | Milberger . | |
| 5,255,743 | 10/1993 | Adam et al. . | |
| 5,282,655 | 2/1994 | Marietta . | |
| 5,332,043 | 7/1994 | Ferguson . | |

*Primary Examiner*—Dennis L. Taylor
*Attorney, Agent, or Firm*—Felsman, Bradley, Vaden, Gunter & Dillon, L.L.P.; James E. Bradley

[57] ABSTRACT

A subsea wellhead connector has an upper body that abuts the rim of a wellhead member. A hydraulic wellhead connector is carried by the upper body and extends over the wellhead member. The hydraulic wellhead connector carries dogs for moving into an engaged position with a profile on the exterior of the wellhead member. The mating or complementary stepped profile at the top or rim of the wellhead housing is designed to engage at three surfaces. The first surface is the flat surface at the inner diameter. The second surface is the tapered surface at the step. The third surface is the flat surface on the rim from the tapered surface to the outer diameter of the rim. The profiles are dimensioned with bias toward initial contact at the outer diameter flat on the rim of the well housing, second contact is at the inner diameter flat on the rim of the well housing, and the third contact is at the tapered step. Additionally, after preload, a lower portion of the lower body of the wellhead connector engages a stepped profile at the outer diameter of the wellhead, thereby creating a secondary load path for reacting to the applied bending moment.

14 Claims, 2 Drawing Sheets

WELLHEAD CONNECTOR WITH ADDITIONAL LOAD SHOULDERS

TECHNICAL FIELD

This invention relates in general to wellhead connectors for connecting to a subsea wellhead.

BACKGROUND ART

Subsea wells normally have a wellhead housing, which is a large tubular member located at the sea floor. Casing will be supported in the wellhead housing by a casing hanger. During drilling, a riser will extend upward from the subsea wellhead housing to a floating platform. A wellhead connector will connect the lower end of the riser to the wellhead housing.

A wellhead connector bolts to the lower end of the blowout preventer (BOP) stack, which is run at the bottom of the riser. The upper body of the wellhead connector is attached to the lower body through bolts which extend through of the upper body into the lower body assembly. The lower body assembly has a cylindrical portion that extends around the wellhead housing. The upper body has a downward facing shoulder that lands on the upper rim of the wellhead housing. A seal is located at the shoulder between the wellhead housing and upper body of the wellhead connector.

A locking element, preferably a set of dogs, are pushed out from a retracted position into engagement with an external profile on the wellhead housing.

While this type of connector is workable, large bending moments due to riser tension may cause the connector to move slightly relative to the wellhead is housing. This movement should be minimized.

DISCLOSURE OF INVENTION

The invention uses deflection of a connector to provide an interference fit at the outer diameter of the wellhead housing. By using the deflection of the connector to provide an interference fit, socket action is developed. This socket action load path increases the bending capacity of the connector by providing a secondary load path for the applied bending moment. The desired socket action is developed by the combined effects of an interference fit at the outer diameter of the wellhead housing that is developed as the hydraulic wellhead connector deflects downward during preload. The desired socket action is additionally developed due to a horizontal load shoulder or stepped profile incorporated at the interface of the upper body of the connector and the wellhead at the top of the wellhead housing. These to two effects are obtained by including a raised profile on the outer diameter of the wellhead housing located below the elevation of the bottom of the lower body, a stepped profile at the rim of the wellhead, and a mating or complementary stepped profile in the upper body.

The raised outer diameter profile is configured such that when the connector body is engaged over a mating wellhead prior to being preloaded, the clearance between the inner diameter profile of the lower body and the outer diameter profile of the wellhead housing is maintained equal to a standard clearance. As the connector is preloaded, the lower body moves downward relative to the wellhead housing due to the deflection of the lower body. After full preload has been developed, the lower body of the connector contacts the raised profile on the outer diameter of the wellhead housing. Tolerances provide either a small gap or an interference fit at the raised profile. Additionally, the mating or complementary stepped profile at the top or rim of the wellhead housing is designed to engage at three surfaces. The first surface is the flat surface at the inner diameter. The second surface is the tapered surface at the step. The third surface is the flat surface on the rim from the tapered surface to the outer diameter of the rim. The profiles are dimensioned with bias toward initial contact at the outer diameter flat on the rim of the well housing, second contact is at the inner diameter flat on the rim of the well housing, and the third contact is at the tapered step. Small amounts of local permanent deformation are acceptable.

BEST MODE FOR CARRY OUT THE INVENTION

Figure 1:
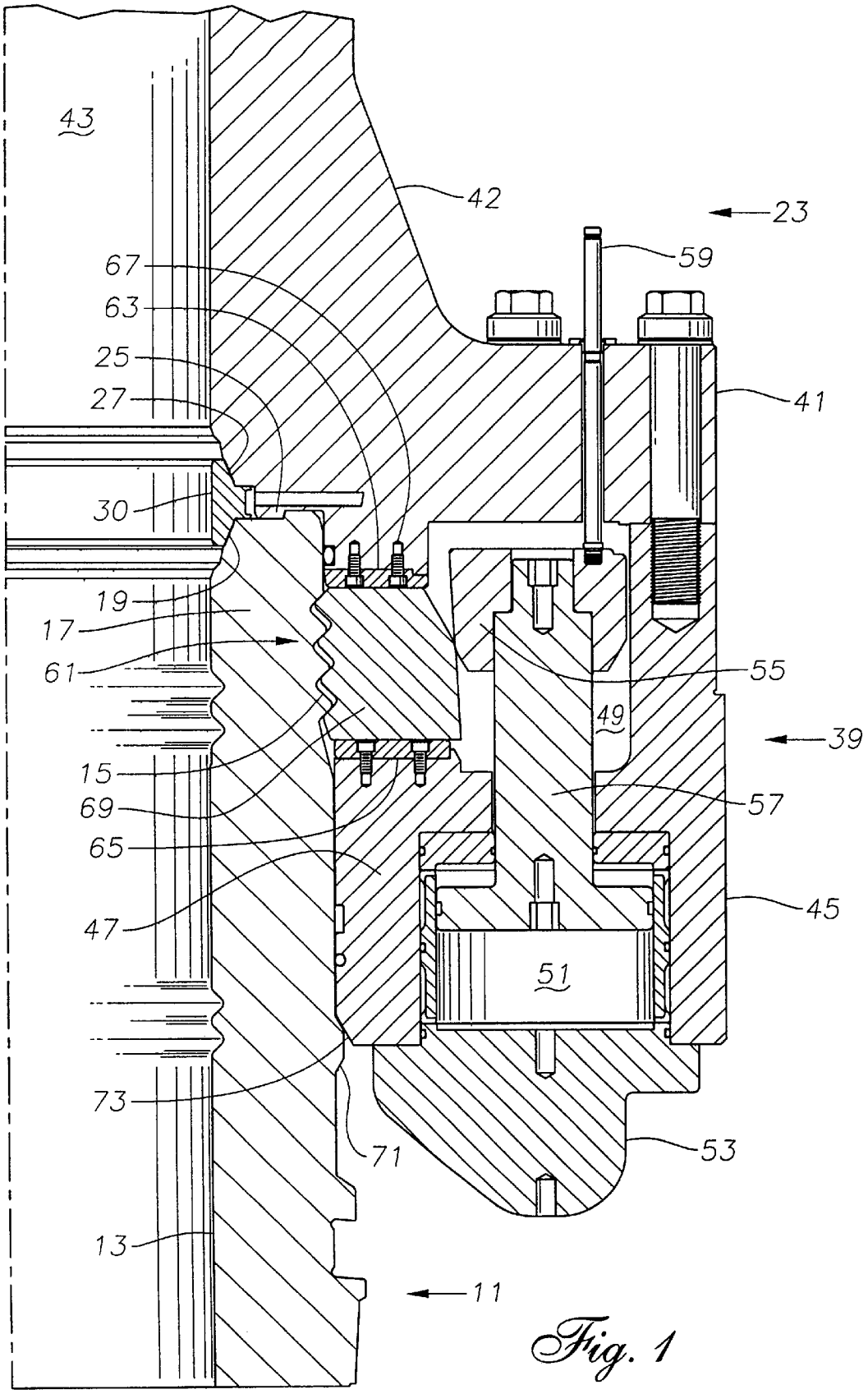
FIG. 1 is a cross-sectional view of the wellhead connector of the invention.

Referring to FIG. 1, a conventional wellhead member 11 is shown. Wellhead member 11 is located on a sea floor and secured to a string of conductor pipe (not shown) which forms the foundation of the well. Wellhead member 11 has an axial bore 13 and an external grooved profile 15. The grooved profile 15 has conical downward facing flanks. A rim 17 has an internal bevel 19 at its inner diameter that is conical.

Figure 2:
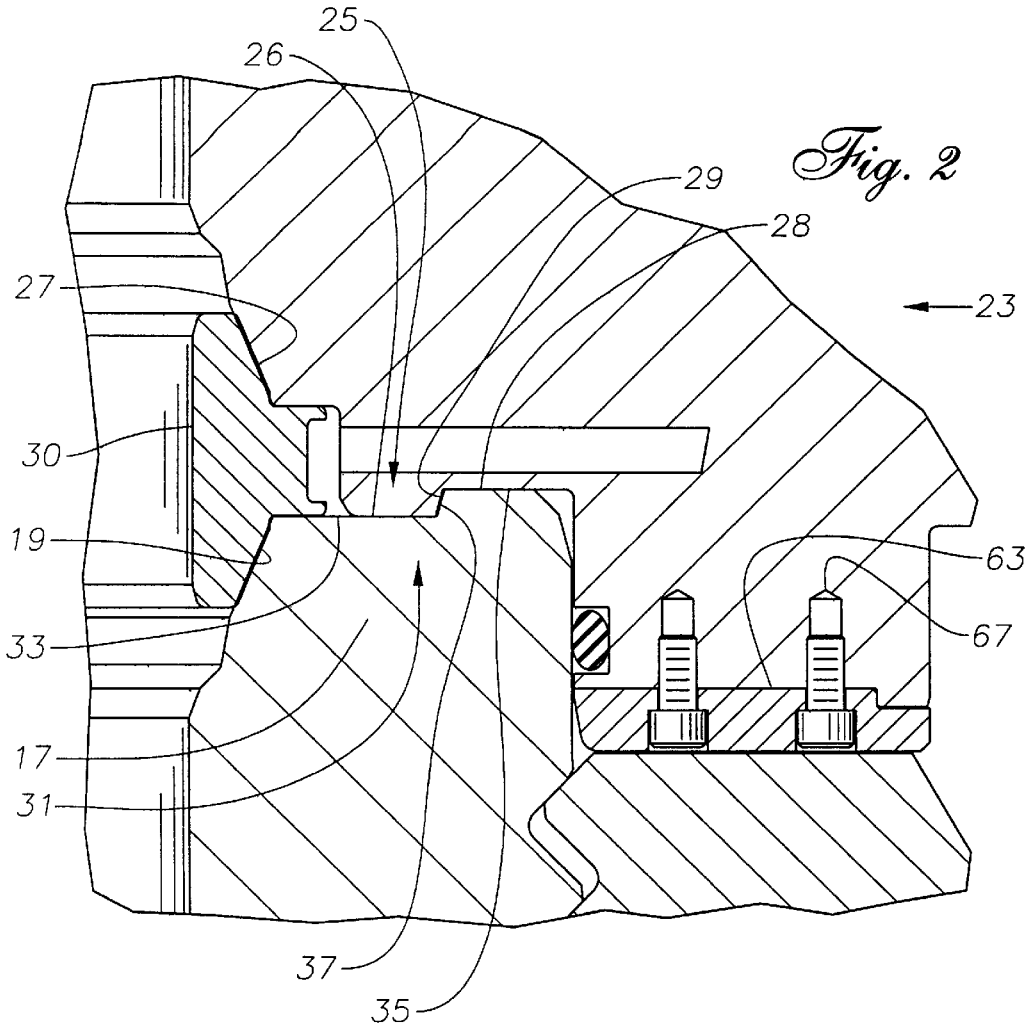
FIG. 2 is an enlarged view of an interface between an upward facing surface of the wellhead member and a downward facing shoulder of the upper body of the wellhead connector of FIG. 1.

Upper body 23 has a downward facing shoulder 25 in its lower end that abuts rim 17 of wellhead member 11. Flat inner surface 26, which is positioned on downward facing shoulder 25, can be most clearly seen in FIG. 2. A conical internal bevel 27 is positioned on downward facing shoulder 25. Flat outer surface 28 is positioned opposite stepped profile 29, which is formed between flat inner surface 26 and flat outer surface 28. A conventional metal seal 30 is secured to upper body 23 in contact with internal bevel 27. When downward facing shoulder 25 abuts rim 17, seal 30 will be energized or deformed between bevels 19 and 27.

Rim 17 of wellhead member 11 has upward facing surface 31, having a flat inner surface 33 and a flat outer surface 35 separated by a stepped shoulder 37, which is preferably tapered. The preferred angle of taper is 15 degrees relative to the vertical axis. Upward facing surface 31 possesses a complementary stepped profile 37 for engagement with stepped profile 29 of downward facing surface 25. Rim 17 has a inner flat surface 33, a tapered shoulder 37, and an outer flat surface 35. Outer flat surface 35 is positioned above the inner flat surface 33. Stepped shoulder 37 is conical and faces inward.

Wellhead connector upper body 23 will connect a riser string (not shown) to the wellhead member 11. The riser string includes a blowout preventer and extends upward to a surface platform. The riser is employed during drilling. A lower body assembly, designated generally 39, as shown in FIG. 1, connects the riser to wellhead member 11. An upper body 23 forms the lower end of the riser. Upper body 23 is a tubular member with an upper end that secures to the blowout preventer at the lower end of the riser string and a lower end which secures to the lower body member 39 and abuts rim 17 of wellhead member 11.

Upper body 23 has a flange 41 at its periphery, which is visible in FIG. 1. Flange 41 is circular and is located at the lower end of a tapered exterior section 42. Tapered section 42 is generally conical and converges in an upward direction. Upper body 23 has an axial passage 43 passing therethrough.

Lower body assembly 39 is connected to an underside of flange 41 proximate the periphery of flange 41. Lower body assembly 39 includes an outer profile 45, an inner profile 47, an upper chamber 49, a lower chamber 51, an to annular cover 53, a cam ring 55 and a cam piston 57. An inner profile 47 is positioned proximate wellhead member 11 and inside of outer profile 45. Outer profile 45 and inner profile 47 define an upper chamber 49 and partially define a lower chamber 51 with annular cover 53.

Upper chamber 49 houses cam ring 55. Cam ring 55 is mounted onto a plurality of cam pistons 57 (only one shown). Cam piston 57 is slidingly housed within upper chamber 49 and lower chamber 51. Rod 59 passes through flange 41 and engages cam ring 55. Rod 59 engages threads only in cam ring 55. No threads are present in the hole in flange 41 for rod 59. Consequently, a downward force imposed on the cam ring 55 will transmit directly to cam ring 55 and not through any threads of rod 59.

Window 61 is formed between a lower surface of upper body 23 and an upper surface of inner profile 47. Window 61 is preferably bordered by upper window plate 63 and lower window plate 65 which are secured by bolts 67. A locking element, preferably a plurality of dogs 69, is positioned within the window 61. Dogs 69 are capable of moving radially inward and outward between a retracted position and an engaged position. Dog 69 is shown in a to partially engaged position in FIG. 1. Dogs 69 have teeth on their inner faces for engaging the external grooved profile 15 of wellhead member 11 when dog 69 is in an engaged position. Cam ring 55 serves as means for moving the dogs 69 between a retracted and engaged position. Cam ring 55 moves downward from an upper position to a lower position and slidingly engages dog 69 to impart a force thereon.

Figure 3:
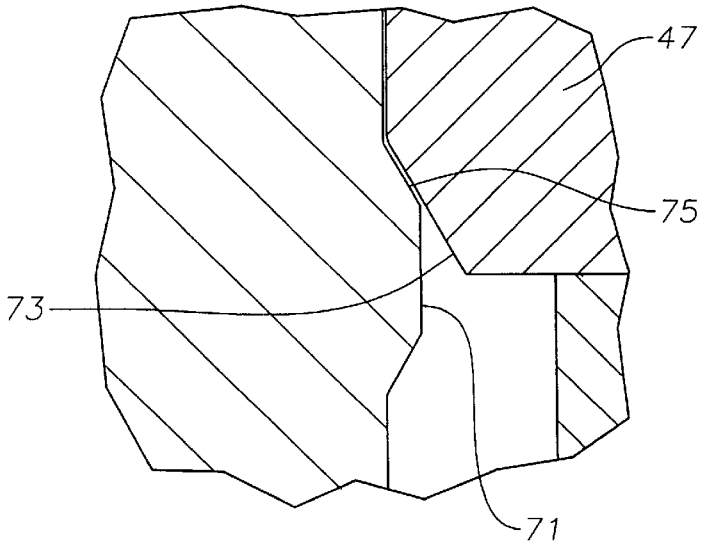
FIG. 3 is an enlarged view of the interface between a raised profile on the wellhead member and a lower portion of the lower body assembly of the wellhead connector of FIG. 1.

Raised profile 71 is formed on wellhead member 11 proximate a lower portion of inner profile 47. Raised profile 71 is engaged by a lower tapered shoulder 73 of an inner diameter of inner profile 47, as can be seen most clearly in FIG. 3. Raised profile 71 is spaced below profile 15 at as great a distance as possible without increasing the overall length of the wellhead connector. Raised profile 71 is also provided with a tapered shoulder 75.

In operation, before preload and after landing upper body 23 of the wellhead connector on rim 17 of wellhead member 11, a slight clearance exists between tapered shoulder 73 and tapered shoulder 75. The preload pulls down lower body 39, preloading shoulders 73 and 75, which wedge against each other, developing an interference fit. Upper body 23 of the wellhead connector compresses or deflects downward slightly. The load path increases the bending capacity of the connector by providing a secondary load path for the applied bending moment.

A horizontal load shoulder is present at the rim 17 of connector member 11. The mating stepped profile at the top of wellhead member 11 is designed to engage downward facing shoulder 25 of upper body 23 at three surfaces. The profiles of the surfaces are dimensioned with a bias toward initial contact at outside flat surface 35. Inner flat surface 33 engages next, and finally stepped profile 37 engages.

We claim:

1. A wellhead assembly comprising:

a tubular upper body having an axis and a downward facing shoulder;

a tubular wellhead member having an upward facing rim for complementary engagement with said downward facing shoulder;

a radially movable locking member carried by said upper body for engaging an external grooved profile on said wellhead member for locking said upper body to said wellhead member for preloading said shoulder and rim into engagement with each other;

a lower body carried by the upper body and surrounding an upper portion of said wellhead member, the locking member being carried by said lower body, said lower body having a tapered lower shoulder axially spaced below said locking member; and a tapered raised profile axially spaced below said grooved profile on said wellhead member which is engaged by said tapered lower shoulder.

2. The wellhead assembly according to claim 1 further comprising:

a stepped profile on said upward facing rim for complementary engagement with a stepped profile on said downward facing shoulder, each of said stepped profiles having an inner flat part and an outer flat part separated by a generally radially facing wall.

3. The wellhead assembly according to claim 1 wherein:

the engagement of said locking member with said external grooved profile causes a plastic deflection of an upper portion of said wellhead member and wedges said tapered lower shoulder onto said raised profile in an interference fit.

4. A wellhead assembly comprising:

a tubular wellhead member having an upward facing rim having an inner flat part and an outer flat part separated by a generally inward facing tapered shoulder, wherein said outer flat part is higher than said inner flat part;

a tubular upper body having a downward facing shoulder having a generally radially inner flat part and an outer flat part separated by an outward facing tapered shoulder for complementary engagement with said inner flat part and said outer flat part of said upward facing rim;

a radially movable locking member for engaging an external grooved profile on said wellhead member for to locking said upper body to said wellhead member for preloading said stepped profiles into engagement with each other, the engagement of said locking member with said external grooved profile causes a deflection of an upper portion of said wellhead member and wedges said tapered shoulders together in an interference fit;

a lower body assembly carried by said upper body and surrounding an upper portion of said wellhead member, said locking member being carried by said lower body assembly, said lower body assembly having a tapered lower shoulder; and a tapered raised profile on said wellhead member which is engaged by said tapered lower shoulder of said lower body assembly.

5. The wellhead assembly according to claim 4 wherein:

said locking member moves radially inward and outward between a retracted position and an engaged position; and said lower body carries a vertically slidable cam piston having a cam mounted on an upper end thereof, said cam for forcing said locking member into said engaged position.

6. The wellhead assembly according to claim 4 wherein said tapered surfaces are conical.

7. The wellhead assembly according to claim 4 wherein said tapered lower shoulder is located at a lower end of said lower body.

8. A method for connecting a riser to a subsea wellhead member with a wellhead connector, the wellhead member having an axis and an upward facing rim, a cylindrical sidewall with a grooved profile, the wellhead connector having an upper body with a downward facing shoulder, a cylindrical skirt depending therefrom, and a radially movable locking member, the method comprising:

providing a raised profile on said cylindrical sidewall at an axial distance below said grooved profile;

engaging the shoulder of the upper body with the rim of the wellhead member;

forcing the locking member into the external grooved profile on said wellhead member; and engaging a tapered lower shoulder of said cylindrical lower body with the raised profile on the wellhead member.

9. A method for connecting a riser to a subsea wellhead member with a wellhead connector according to claim 8 wherein said step of forcing said locking member into the external grooved profile on said wellhead member causes said wellhead member to plastically deflect, and wedges said tapered lower shoulder onto said raised profile in an interference fit.

10. A method for connecting a riser to a subsea wellhead member with a wellhead connector according to claim 8, further comprising:

providing on the rim and on the downward facing shoulder a stepped profile having an inner flat part and an outer flat part separated by a generally radially facing wall; and engaging the stepped profiles when the downward facing shoulder engages the rim.

11. A wellhead assembly comprising:

a tubular upper body having an axis and a downward facing shoulder having a stepped profile, said stepped profile having an inner flat part and an outer flat part separated by a generally radial facing wall;

a tubular wellhead member having an upward facing rim with a stepped profile having an inner flat part and an outer flat part separated by a generally radial facing wall, said stepped profile for complimentary engagement with said stepped profile of said downward facing shoulder;

a radially movable locking member carried by said upper body for engaging an external grooved profile on said wellhead member for locking said upper body to said wellhead member for preloading said stepped profiles into engagement with each other; and a lower body carried by the upper body and surrounding an upper portion of said wellhead member, the locking member being carried by said lower body.

12. The wellhead assembly according to claim 11 wherein said outer flat part of said rim is above said inner flat part of said rim.

13. The wellhead assembly according to claim 11 wherein said wall of said upward facing rim is tapered for complementary engagement with said wall of said downward facing shoulder.

14. The wellhead assembly according to claim 13 wherein said outer flat part of said rim is above said inner flat part of said rim.

* * * * *

UNITED STATES PATENT AND TRADEMARK OFFICE

CERTIFICATE OF CORRECTION

PATENT NO. : 6,138,762

DATED : October 31, 2000

INVENTOR(S) : Thomas F. Sweeney, et. al.

It is certified that error appears in the above-identified patent and that said Letters Patent is hereby corrected as shown below:

Column 1, Line 34, please delete "is".

Column 1, Line 53, please delete "to".

Column 3. Line 13, please delete "to".

Column 3, Line 35, please delete "to".

Column 4, Line 46, before "locking," please delete "to".

Signed and Sealed this

Twenty-second Day of May, 2001

Nicholas P. Godici

*Attest:*

NICHOLAS P. GODICI

*Attesting Officer*

*Acting Director of the United States Patent and Trademark Office*